US006500057B1

(12) United States Patent
Medina

(10) Patent No.: US 6,500,057 B1
(45) Date of Patent: Dec. 31, 2002

(54) DRYWALL ABRASIVE SANDING DISK, SANDING PAD, AND METHOD

(76) Inventor: Vinicio Medina, 9 Charles Way, Chelmsford, MA (US) 01824

( * ) Notice: Subject to any disclaimer, the term of this patent is extended or adjusted under 35 U.S.C. 154(b) by 74 days.

(21) Appl. No.: 09/634,404

(22) Filed: Aug. 9, 2000

(51) Int. Cl.[7] ..... B24B 27/027

(52) U.S. Cl. ..... 451/354; 451/359; 451/456; 451/538

(58) Field of Search ..... 451/354, 359, 451/356, 456, 353, 168, 533, 538; 15/418

(56) References Cited

U.S. PATENT DOCUMENTS

| | | | | | |
|---|---|---|---|---|---|
| 3,866,361 | A | * | 2/1975 | Mauck | 451/168 |
| 3,875,703 | A | * | 4/1975 | Clemente | 451/168 |
| 4,287,685 | A | | 9/1981 | Marton | |
| 4,558,542 | A | | 12/1985 | Marton | |
| 5,036,627 | A | | 8/1991 | Walters | |
| 5,239,783 | A | | 8/1993 | Metechuk | |
| 5,383,309 | A | | 1/1995 | Sampietro | |
| 5,690,545 | A | * | 11/1997 | Clowers et al. | 451/359 |
| 5,807,161 | A | | 9/1998 | Manor et al. | |
| 5,962,120 | A | | 10/1999 | Keipert | |
| 6,027,399 | A | * | 2/2000 | Stewart | 451/353 |
| 6,050,887 | A | * | 4/2000 | Chang | 451/458 |
| 6,280,309 | B1 | * | 8/2001 | Van Osenbruggen | 451/415 |

* cited by examiner

*Primary Examiner*—Lee Wilson
(74) *Attorney, Agent, or Firm*—O'Connell Law Firm

(57) ABSTRACT

An abrasive sanding disk and sanding pad combination for use in sanding drywall surfaces with a motorized drywall sander with a sanding head, the abrasive sanding disk and sanding pad combination comprising an abrasive sanding disk comprising a flat, circular substrate panel wherein the substrate panel is devoid of a central aperture, wherein the substrate panel has a first face comprising a sanding head engaging face for facing a sanding head of a drywall sander and a second face comprising an abrasive face for abrading a given surface; and a sanding pad for being interposed between the abrasive sanding disk and a sanding head of a drywall sander wherein the sanding pad comprises a round disk of resiliently compressible material with a concentric central aperture, an abrasive disk engaging face for engaging the abrasive sanding disk, and a sanding head engaging face for engaging a sanding head of a drywall sander. A layer of pressure sensitive adhesive, which can be shielded by a removably layer of protective film, can be disposed over substantially the entire sanding head engaging face of the substrate panel whereby the abrasive sanding disk can be affixed to a sanding head of a drywall sander. The sanding pad can have an abrasive disk engaging face that comprises a smooth surface and a sanding head engaging face that is textured.

20 Claims, 7 Drawing Sheets

DRYWALL ABRASIVE SANDING DISK, SANDING PAD, AND METHOD

FIELD OF THE INVENTION

The present invention relates generally to abrasive devices. Stated more particularly, the present patent discloses and protects a removably attachable abrasive disk, which may be used in combination with a particularly designed sanding pad, that is particularly designed for use relative to motorized rotary drywall sanding tools.

BACKGROUND OF THE INVENTION

One knowledgeable in the art of drywall installation will be well aware that, after the joints between adjacent panels have been filled and taped, the proper installation of drywall requires that the installer sand each joint to reduce it to the level of each adjacent drywall panel thereby smoothing it over such that all evidence of the joint is eliminated after painting.

In the past, and still to a lesser extent today, this necessary sanding has been performed manually, typically with a sheet of sandpaper wrapped around a sanding block. To improve reach, sanding blocks have been hingedly coupled to an end of an elongate pole. As any person who has engaged in either method of sanding will attest, manual sanding by either method quickly proves to be laborious and tiresome.

Advantageously, a number of prior art inventors have developed motorized sanders that retain a typically round or rectangular article of abrasive material, such as sandpaper, and rotate or reciprocate the abrasive sanding article rapidly. With this, the abrasive sanding article can be applied to a drywall panel to be sanded thereby improving a worker's speed and efficiency. Indeed, a number of motorized sanders have been disclosed that are directed particularly to the art of drywall sanding. By way of example, a motorized drywall sander and improvements thereto are described in U.S. Pat. Nos. 4,782,632 and 5,239,783, both to Matechuk and both entitled "Drywall Sander."

Typically, the abrasive sanding article employed relative to motorized drywall sanders comprises an annular abrasive sanding disk with a concentric annular cutout in the center thereof. When the abrasive sanding article comprises a disk, a back-up pad is normally used to mount or attach the abrasive sanding disk to the drywall sander. Certain prior art back-up pads have a first side to which the abrasive sanding disc is attached and a second side from which a bolt or screw extends to couple to the sanding head of the drywall sander. In other cases, the sanding head has an abrasive sanding disc adhered to a sanding pad, and the two are mounted concentrically on a sanding drive plate such that the abrasive sanding disk can be driven rotatably by a flexible drive shaft. The sanding pad and abrasive sanding disk can be mounted in contact with a sanding drive plate in a shroud by a washer and nut that threadedly engage a retaining spindle that extends from the sanding head. Alternatively, the sanding pad and abrasive sanding disk can be fixed in place by a retaining bolt and washer that pass through the central aperture in the pad and disk and into engagement with the sanding drive plate.

Unfortunately, a number of problems derive from these prior art constructions. Indeed, since the initial introduction of motorized drywall sanders, practitioners in the art have been confronted with issues relating to the attachment, wear, and removal and replacement of the abrasive sanding panels that are coupled to the sanding head of motorized drywall sanders. For example, removing and replacing the sanding pad and abrasive sanding disk on prior art drywall sanders typically requires a user to employ a tool, such as a screwdriver or wrench. This inevitably results in inconvenience and work stoppage for the user.

Furthermore, the central apertures in the sanding pad and the abrasive sanding disk commonly increase the vulnerability of the abrasive sanding disk, and possibly the sanding pad, to tearing when the drywall sander encounters a significant irregularity, such as an electrical outlet or the like, in the surface to be sanded. Not only is a tear in the abrasive sanding disk detrimental because it compels early replacement of the disk, but it is also problematic because the material used to cover drywall tape and to fill the joints between adjacent panels and in screw indentations is easily abraded. Also, the paper surface of the drywall panels can be damaged easily when sanding. A torn or otherwise damaged abrasive sanding disk can quickly result in scoring or other damage to the surface. Absent time consuming repair, such damage mars the appearance of the finished work.

A number of solutions to the problem of providing a readily removable and replaceable abrasive sanding disk have been attempted. For example, U.S. Pat. No. 5,239,783 discloses attaching the abrasive sanding disk to a drive plate by a twist-lock, bayonet-type fastener that takes the place of the retaining bolt of earlier devices. However useful, such a fastener nonetheless leaves uncured the problems that derive from having a central aperture in the abrasive sanding disk and the expense resulting from having to replace the abrasive sanding disk and sanding pad unitarily.

Other prior art inventors have developed systems for removably coupling the abrasive sanding disk to the sanding pad by means of hook and loop fasteners. Under these systems, hook fasteners are disposed on a facing surface of either the abrasive sanding disk or the sanding pad while loop fasteners are disposed on a facing surface of the other of the abrasive sanding disk and sanding pad. With this, the abrasive sanding disk can be removed and replaced relative to the sanding pad by pulling the hook fasteners out of engagement with the loop fasteners. Unfortunately, such devices exhibit a number of problems. For example, the hooks and loops in such devices commonly become clogged with sanding debris and the like.

Yet another flawed practice that has been used in the past is to bond the sanding disk to the sanding pad by use of what is termed a feathering adhesive. Such a practice is described particularly in U.S. Pat. No. 4,558,542 to Marton for a "Stick-On Abrasive Disc." Unfortunately, this practice is disadvantageous for a number of reasons. For example, a user must apply the adhesive or glue both to the disk and to the backup pad by applying it to each individually or by applying the glue to the abrasive sanding disk and then rubbing the disk against the sanding pad to spread the adhesive evenly.

By doing so, adhesive can get onto the abrasive side of the disk whereupon it can get onto and mar or damage the surface to be sanded. The adhesive also can plug up the sanding disk. Still further, the sandpaper in many cases tears up in use and also when the operator tries to remove it from the backup pad thereby leaving small pieces or chunks of the abrasive sanding disk. Consequently, completely removing the sanding disk from the sanding pad is nearly impossible whereby a user must glue a new disk over the remaining portions of previous disks. With this, the new disk does not lie flatly and presents an uneven and unbalanced operative surface that can lead to a marking of the surface to be sanded, uneven wear on the abrasive sanding disk, and a tearing of the disk during use.

A still further deficiency exhibited by prior art abrasive sanding disks for drywall derives from their overall configuration. As was noted above, drywall abrasive sanding disks are manufactured as round disks with a concentric, round aperture formed therein. That round aperture is necessary to allow access to the fastener arrangement that fixes the sanding pad in place. Disadvantageously, the central aperture presents an additional edge on the abrasive sanding disk that can, and often does, catch on anomalies, such as an open utility box in a sheet of drywall, in a surface to be sanded. With this, the disks often tear apart thereby leading to added expense and loss of active work time.

In light of the foregoing, one will appreciate that, notwithstanding the plurality of abrasive structures that have been disclosed by the prior art, there remains a need for an abrasive sanding disk and sanding pad particularly designed for drywall sanding that are durable, effective, and easily removable and replaceable.

SUMMARY OF THE INVENTION

Advantageously, the present invention is founded on the basic object of providing an abrasive sanding disk and sanding pad that are particularly crafted for sanding drywall and that meet the needs as of yet left unmet by the prior art.

A more particular object of the invention is to provide an abrasive sanding disk for drywall sanding that can be removed and replaced quickly and easily relative to a sanding head of a drywall sander.

A further object of the invention is to provide an abrasive sanding disk particularly designed for drywall sanding that demonstrates added durability over prior art abrasive sanding disks.

Still another object of the invention is to provide an abrasive sanding disk that demonstrates improved drywall sanding results as compared to prior art abrasive sanding disks.

Yet another object of the invention is to provide an abrasive sanding disk that resists causing damage to a drywall surface to be sanded.

An even further object of the invention is to provide an abrasive sanding disk and sanding pad combination that allows a plurality of abrasive sanding disks to be used relative to a particularly crafted sanding pad without requiring replacement of the sanding pad.

Of course, these and further objects and advantages of the invention would be readily obvious not only to one skilled in the art who reviews the present disclosure and the accompanying drawing figures but also to one who has an opportunity to take advantage of an embodiment of the present invention.

In accomplishing the aforementioned objects, a most basic embodiment of the invention comprises an abrasive sanding disk and sanding pad combination for use in sanding drywall surfaces by use of a motorized drywall sander with a sanding head. The abrasive sanding disk is founded on a flat, circular substrate panel that, in a marked deviation from prior art abrasive sanding disks for drywall sanders, is devoid of a central aperture. The substrate panel has a first face comprising a sanding head facing face for facing a sanding head of a drywall sander and a second face comprising an abrasive face for abrading a given surface. The sanding pad, which is designed to be interposed between the abrasive sanding disk and a sanding head of a drywall sander, comprises a round disk of resiliently compressible material with a concentric central aperture. The sanding pad has an abrasive disk engaging face for engaging the abrasive sanding disk and a sanding head engaging face for engaging the sanding head of the drywall sander.

A layer of adhesive, ideally pressure sensitive adhesive, is preferably disposed over substantially the entire sanding head engaging face of the substrate panel. With this, the abrasive sanding disk can be affixed to a sanding head of a drywall sander by applying the sanding head engaging face of the substrate panel to the sanding head. Even more preferably, a flexible protective film can overly the layer of pressure sensitive adhesive on the sanding head engaging face to cover and protect the layer of pressure sensitive adhesive. Advantageously, the layer of pressure sensitive adhesive can be exposed by a peeling of the protective film away from the layer of pressure sensitive adhesive. Most preferably, the abrasive sanding disk will have a diameter of about nine inches, which will ensure its proper coupling to a standard drywall sander.

In certain preferred embodiments, the abrasive disk engaging face of the sanding pad will comprise a smooth surface. With this, the layer of pressure sensitive adhesive of the sanding head facing face of the abrasive sanding disk can be applied to the abrasive disk engaging face of the sanding pad and peeled therefrom without damage to the abrasive sanding disk or the sanding pad. Ideally, the sanding head engaging face of the sanding pad will be textured to improve frictional contact between the sanding head engaging face of the sanding pad and the sanding head.

With certain embodiments of the present invention for an abrasive sanding disk and sanding pad combination generally described, one will appreciate that the foregoing discussion broadly outlines the more important features of the invention merely to enable a better understanding of the detailed description that follows and to instill a better appreciation of the inventor's contribution to the art. Before any particular embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As is the case with many inventions, the present invention for an abrasive sanding disk and sanding pad combination is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
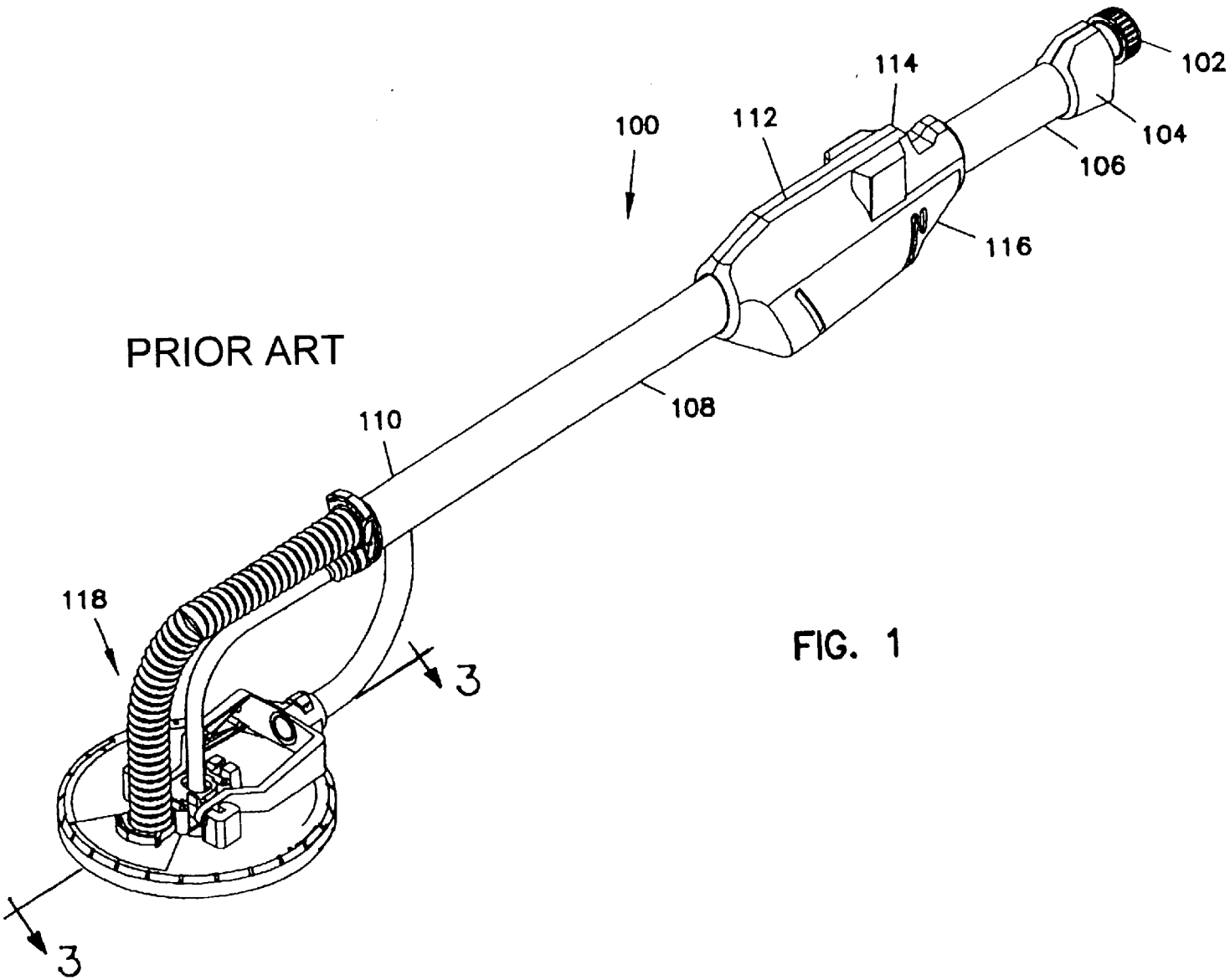
FIG. 1 is a perspective view of a prior art drywall sander.

With this in mind and looking more particularly to the accompanying figures, one can gain a measure of understanding of the overall structure of a typical prior art drywall sander by reference first to FIG. 1 where a motorized drywall sander is indicated generally at 100. A dual chamber tubular wand 108 has a proximal end 106 with a hose clamp nut 102 attached to a vacuum adapter housing set 104. Also coupled adjacent to the proximal end 106 of the tubular wand 108 is a drive motor 112, which is operably coupled in line with the tubular wand 108. Coupled to the distal end 110 of the tubular wand 108 is a sanding head 118. Advantageously, when so coupled to the proximal and distal ends 106 and 110 of the tubular wand 108, the sanding head 118 and the drive motor 112 tend to locate a balancing point at or near a mid-point along the length of the tubular wand 108 of the drywall sander 100. The preferred drive motor 112 is a variable speed fractional horsepower electric motor. The drive motor 112 includes an on/off toggle switch 114, and motor speed can be adjusted by operation of a variable speed thumb wheel switch 116 that is located on an opposite side of the tubular wand 108 from the on/off switch 114.

Figure 2:
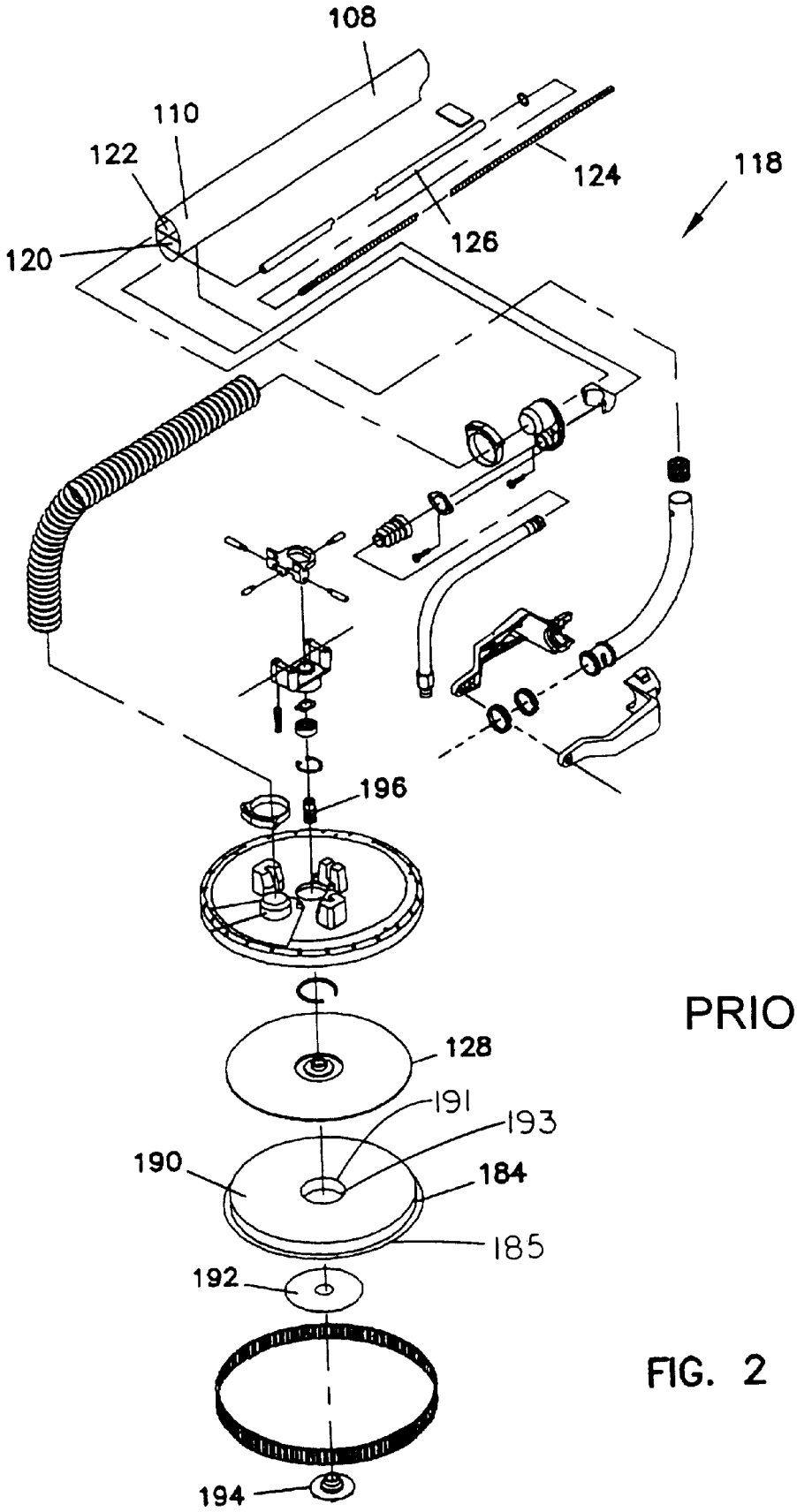
PRIOR ART FIG. 2
FIG. 2 is an exploded view of a sanding head of a prior art drywall sanding head.

Looking next to FIG. 2, which provides an exploded view of the sander head 118, one sees that the distal end 110 of the tubular wand 108 is separated into a lower chamber 120 and an upper chamber 122. Each of the upper and lower chambers 122 and 120 extend along the length of the tubular wand 108. A flexible drive shaft 124 is retained in a guide tube 126 and travels along the length of the tubular wand 108 within the lower chamber 120. The drive shaft 124 is drivably coupled at a first end to the drive motor 112 and drivingly coupled at a second end to the sander head 118.

A vacuum line travels along the second chamber 122 from the distal end 110 to the proximal end 106 of the tubular wand 108 where it meets the vacuum hose clamp 102 of FIG. 1. The vacuum line within the second chamber 122 is completely separate and sealed from the first chamber 120 of the tubular wand 108 and is also sealed relative to the drive motor 112. With this, any dust or debris drawn through the vacuum line does not come into contact with either the flexible drive shaft 124 or the drive motor 112 as it passes through the tubular wand 108. To be complete, one will note that the vacuum hose clamp 102 is preferably configured to receive a flexible vacuum hose, which is not shown.

Figure 3:
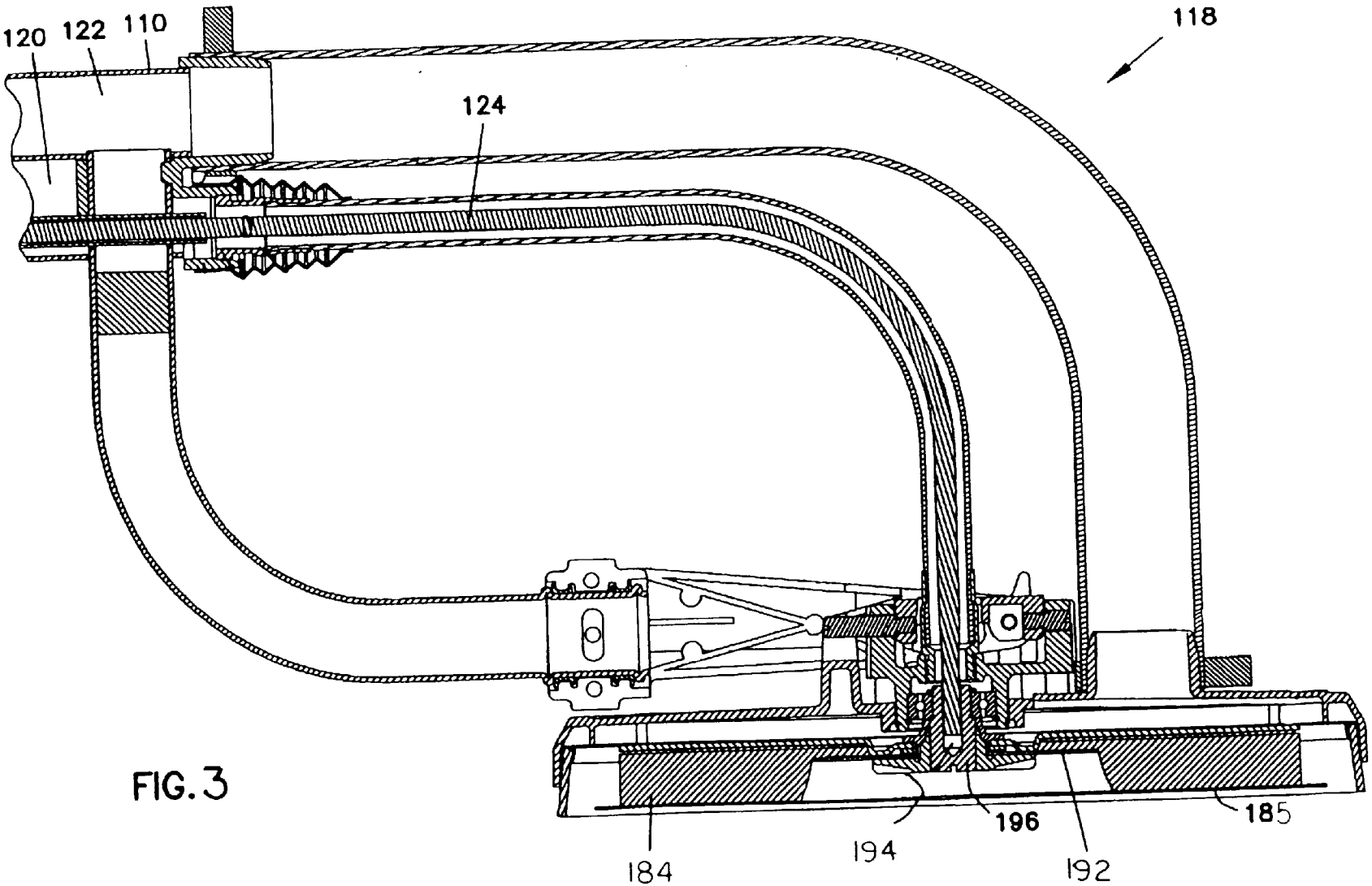
FIG. 3 PRIOR ART
FIG. 3 is a cross sectional view of the drywall sanding head of FIG. 1 taken along the line 3—3 in FIG. 1.

The sanding head 118 is mounted by a pivotal joint to the distal end 110 of the tubular wand 108. The sanding head 118 rotatably retains a round sanding drive plate 128. The flexible drive shaft 124 is drivingly coupled to the sanding drive plate 128 to induce the sanding drive plate 128 to rotate in response to a rotation of the flexible drive shaft 124. A round sanding pad 184 with a concentric annular aperture therein is pressed into frictional engagement with the sanding drive plate 128 by a large washer 192 (i.e., a three inch metal washer) in combination with a retaining nut 194 (i.e., a two inch plastic nut) that engage a retaining spindle 196 as can be best seen in FIG. 3.

Notably, the sanding drive plate 128 is covered with an abrasive material that serves to prevent slippage of the sanding drive plate 128 relative to the sanding pad 184. When the sanding drive plate 128 is coupled to the sanding head 118, the retaining nut 194 and the washer 192 reside below the plane of the outer face of the sanding pad 184 whereby the outer face of the sanding pad 184 presents a flat surface except for the annular aperture 191, which effectively comprises a depression in the outer face. In the prior art, sanding pads 184 typically comprise a disk of resilient material, such as plastic foam, with a central aperture 191. For example, a disk of a given thickness of foamed polyurethane or the like is commonly employed.

Of course, as FIG. 2 shows, an abrasive sanding disk 185 must somehow be coupled to the sanding pad 184. One knowledgeable in the art will be aware that prior art constructions, such as that shown in FIG. 2, have coupled the sanding disk 185 to the sanding pad 184 in a number of ways. One most basic way is to fix the sanding disk 185 to the sanding pad 184 irremovably by a proper adhesive or the like. With this, the sanding disk 185 and the sanding pad 184 essentially comprise a single unit and must be bought, sold, installed, and removed as such.

Another common method and device for applying an abrasive sanding disk to 185 to a sanding pad 184 is described in U.S. Pat. No. 4,558,542 where a layer of feathering adhesive is applied to the sanding pad 184 and abrasive disk 185 with a smooth-coated face is applied over the feathering adhesive. With this, it is said that, when worn, the abrasive disk 185 can be pulled away from the sanding pad 184 while leaving the feathering adhesive on the sanding pad 184 so that another abrasive disk 185 can be applied thereto.

Still other inventors have proposed removably and replacably coupling an abrasive disk 185 to a sanding pad 184 by appropriately arranged hook and loop material disposed on the mating faces of the sanding pad 184 and the abrasive disk 185. In each known case, the abrasive disk 185 has had a central aperture 193 for allowing the washer 192 and nut 194 to pass therethrough.

Figure 4:
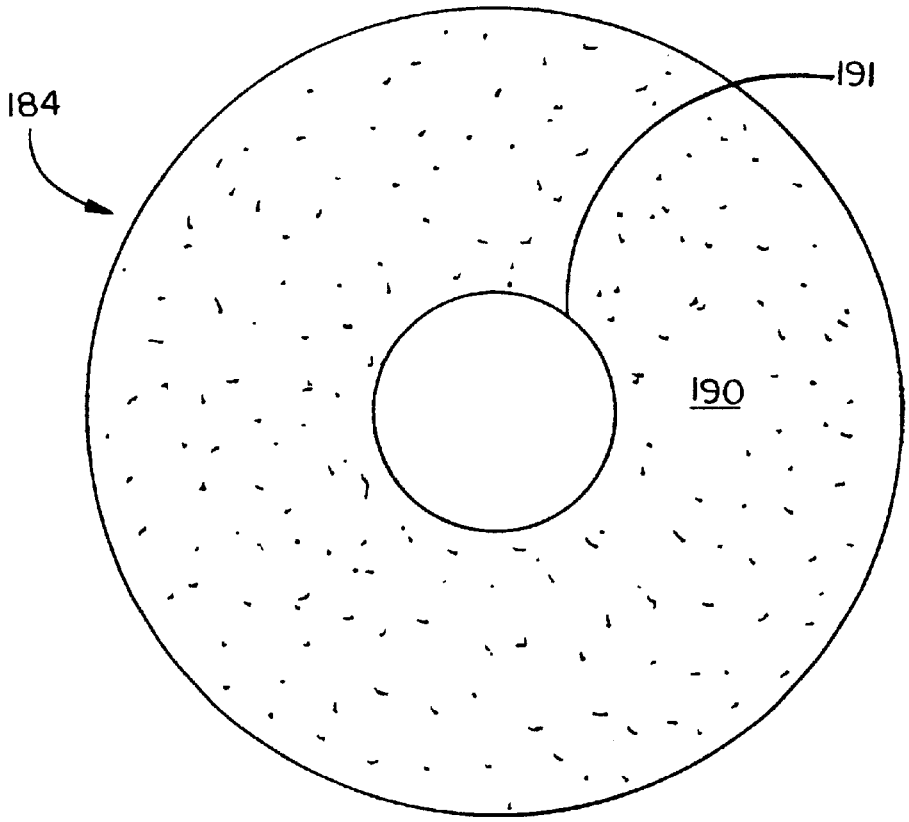
FIG. 4 is a top plan view of a sanding pad according to the present invention.
Figure 5:
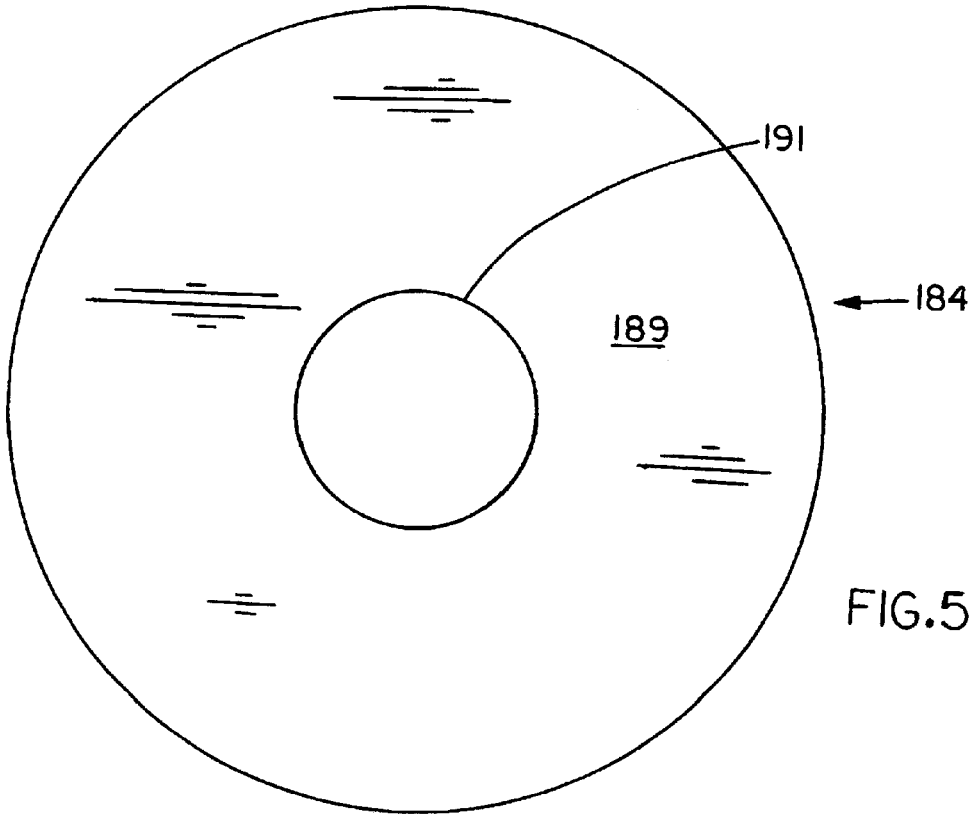
FIG. 5 is a bottom plan view of the sanding pad of FIG. 4.

The present invention departs from these prior art methods and devices in the material, structure, and function of both the sanding pad 184 and the abrasive disk 185. Under the instant invention, as FIGS. 4 and 5 show, the sanding pad 184 comprises a disk of resiliently compressible material with a central aperture 191. With this, the sanding pad combination.

Looking to FIG. 4, which shows what could be considered a top plan view of the sanding pad 184, one sees that the sanding pad 184 has a sanding drive plate engaging face 190 for engaging, as its name would suggest, the sanding drive plate 128. The sanding drive plate engaging face 190 in this embodiment is textured to ensure proper frictional engagement between the sanding pad 184 and the sanding drive plate 128.

Referring next to FIG. 5, which shows what can be considered a bottom plan view of the sanding pad 184, one sees that the sanding pad 184 has an abrasive disk engaging face 189 opposite the sanding drive plate engaging face 190 for engaging an abrasive disk 185. Notably, the abrasive disk engaging face 189 is not textured. Instead, the abrasive disk engaging face 189 is smooth, preferably ultra-smooth. As one skilled in the art will appreciate, this could be brought about in a number of ways. For example, it could simply be molded smooth, or the abrasive disk engaging face 189 could be heated to achieve smoothness. Still further, the abrasive disk engaging face 189 could comprise a smooth, flexible coating of, by way of example only, nylon, a properly chosen plastic, an ethylene-polyvinyl acetate copolymer, or similar coating. These materials advantageously would form a smooth, flexible film on the sanding pad 184 and would act as the abrasive disk engaging face 189. Also, employing such a film advantageously would improve the durability of the sanding pad 184.

The preferred material for the sanding pad 184 is resiliently compressible. With this, it could take a number of forms including rubber or the like. Advantageously, the present inventor has discovered that, in a most preferred embodiment, the sanding pad 184 is formed from white rubber which is particularly advantageous for a number of reasons. For example, a sanding pad 184 formed from white rubber can be crafted with an exceptionally smooth abrasive disk engaging face 189 that is also possessed of exceptional resistance to tearing. With this, as will be discussed more fully hereinbelow, abrasive disks 185 (shown, for example in FIGS. 6–9) can be adhered to and peeled from the sanding pad 184 without damage to the sanding pad 184.

Figure 5A:
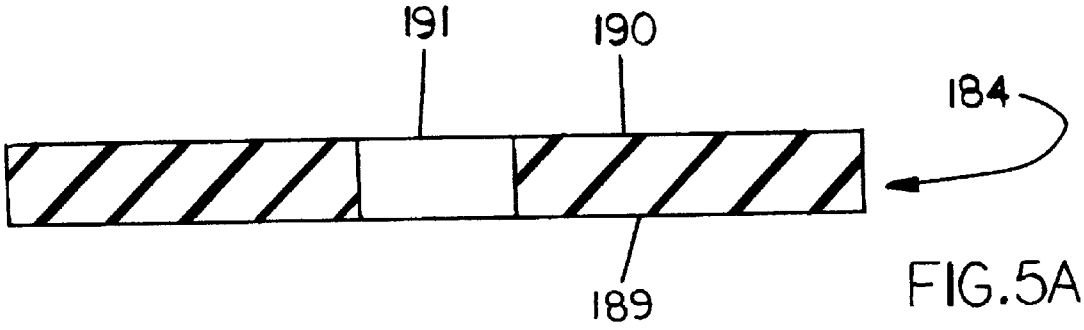
FIG. 5A is a cross sectional view of a sanding pad according to the present invention.

FIG. 5A shows such a sanding pad 184 in cross section. There, one sees that, where the sanding pad 184 is formed from white rubber, the sanding pad 184 can be formed as a singular member with a first side comprising the textured drive plate engaging face 190 and a second side comprising the abrasive disk engaging face 189.

Figure 5B:
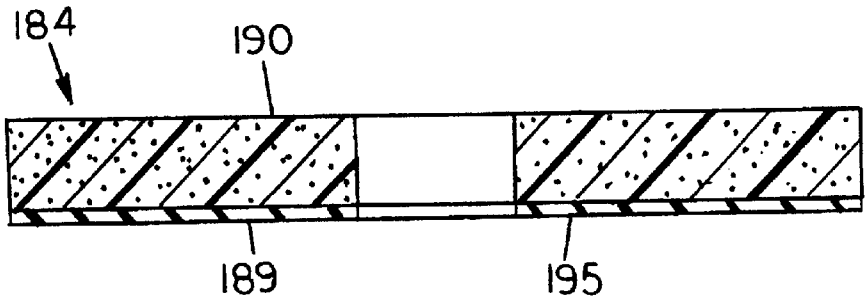
FIG. 5B is a cross sectional view of an alternative sanding pad.

FIG. 5B shows an alternative sanding pad 184 that is formed, not from white rubber, but instead from a foam material, such as a plastic foam. Since such a foam material typically will not demonstrate the durability and resistance to tearing that a white rubber would demonstrate, the abrasive disk engaging face 189 of the sanding pad 184 could well tear when an abrasive disk 185 is attempted to be peeled therefrom. To prevent this, the abrasive disk engaging face 189 in this embodiment comprises a thin panel of rubber 195 that is affixed to the main body of the sanding pad 184.

Figure 5C:
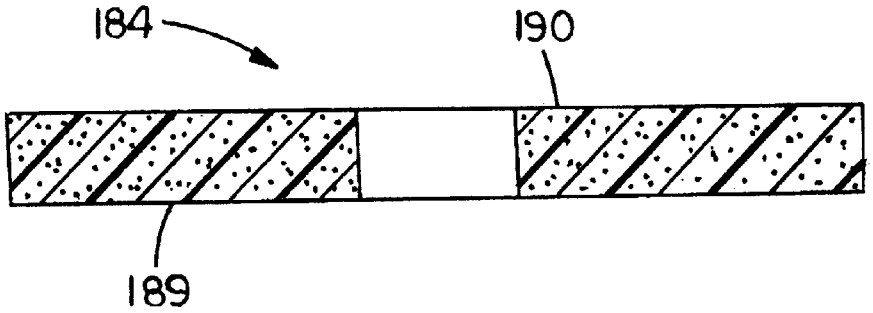
FIG. 5C is a cross sectional view of another alternative sanding pad.

As FIG. 5C shows, however, it is possible that the sanding pad 184 could be formed from a foam material without having a panel of rubber 195 affixed thereto. In such a case, one will appreciate that the sanding pad 184 could not be expected to demonstrate the durability likely to be enjoyed by the embodiments of FIGS. 5A and 5B. However, such a sanding pad 184 could be preferred in circumstances where economy in initial cost is an important factor.

Figure 6:
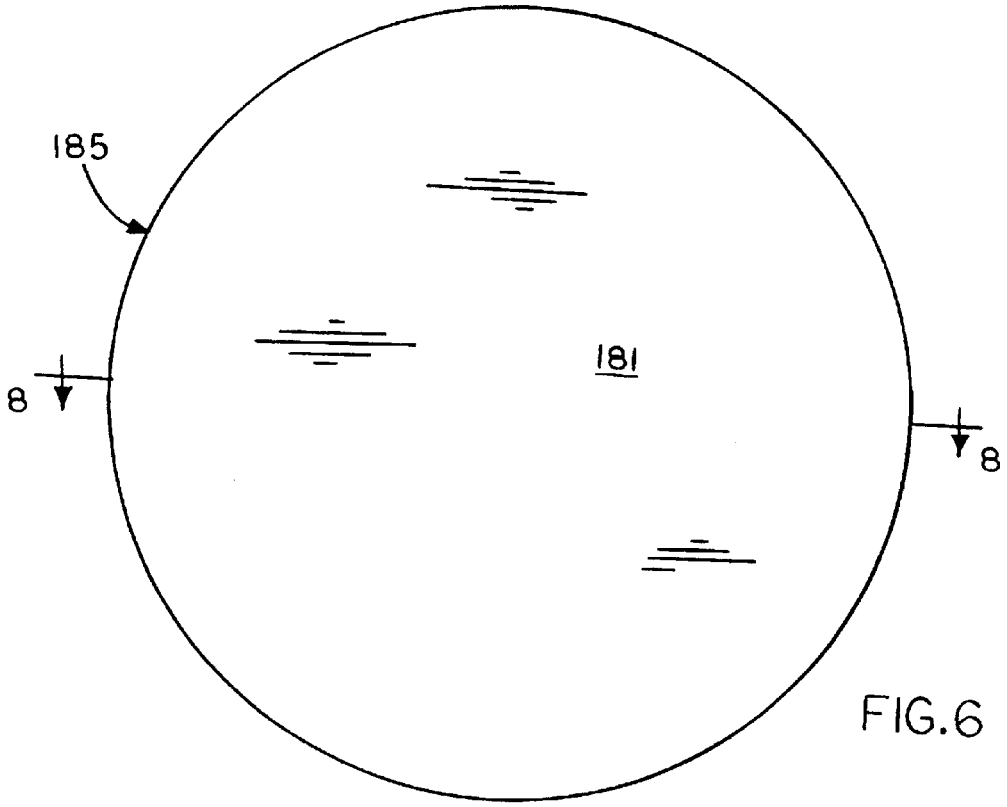
FIG. 6 is a top plan view of an abrasive sanding disk according to the present invention.
Figure 7:
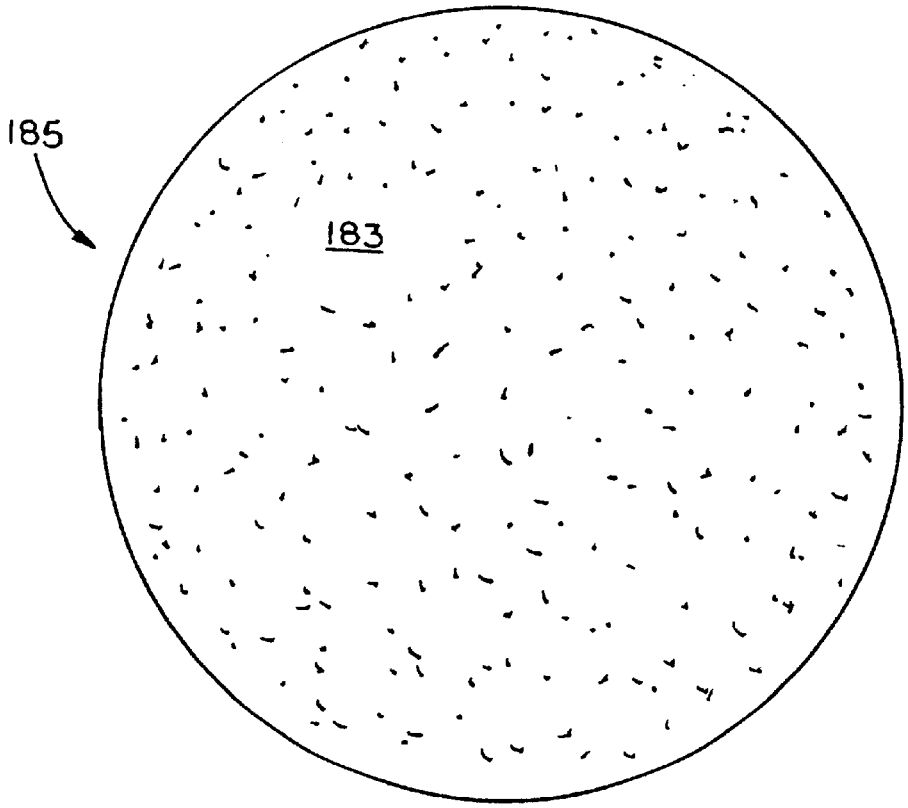
FIG. 7 is a bottom plan view of the abrasive sanding disk of FIG. 6.
Figure 8:
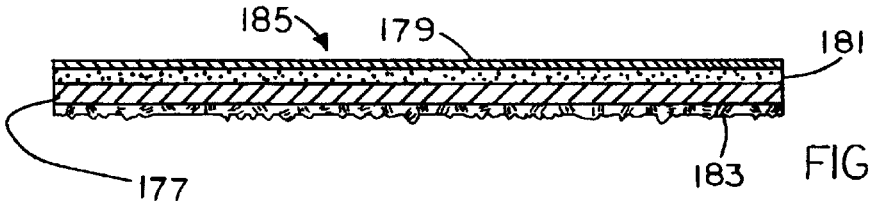
FIG. 8 is a cross sectional view of the abrasive sanding disk taken along the line 8—8 in FIG. 6.

Looking next to FIGS. 6, 7, and 8, one sees a preferred embodiment of an abrasive sanding disk 185 according to the present invention in top plan, bottom plan, and cross-sectional views, respectively. By combined reference to the top plan view of FIG. 6 and the cross-sectional view of FIG. 8, one sees that the sanding disk 185 is founded on a substrate layer 177. Preferably, the substrate layer 177 is formed from a strong and durable fabric, such as heavy duty canvas or the like. This preferred abrasive sanding disk 185 has a diameter of approximately nine inches whereby it is particularly suitable for use with a standard drywall sander 100.

Notably and in a marked departure from prior art abrasive sanding disks 185 for drywall sanders 100, the abrasive sanding disk 185 does not have a central aperture therein. Instead, the abrasive sanding disk 185 comprises a flat, solid, circular panel. Advantageously, by being readily removable and replaceable relative to the sanding pad 184, the abrasive sanding disk 185 can be a solid panel while still allowing a user to access the washer 192 and nut 194 readily to remove and replace the sanding pad 184 as necessary. The solid nature of the abrasive sanding disk 185 has proven most advantageous in that it reduces the propensity of the abrasive sanding disk 185 to tear during a sanding operation. As one knowledgeable in the art will appreciate, this represents a marked advance over prior art abrasive sanding disks 185 that have central apertures 193, which have shown a tendency to rip and tear upon passing over anomalies, such as exposed electrical boxes and the like, in a surface to be sanded.

The abrasive sanding disk 185 has a sanding pad engaging face 181, which may also be termed a sanding head facing face 181, that is formed from a layer of adhesive, preferably pressure sensitive adhesive. The sanding pad engaging face 181 underlies a protective layer 179 of flexible plastic or the like that can be stripped from the sanding pad engaging face 181 thereby leaving it exposed. With this, the sanding pad engaging face 181 of the abrasive sanding disk 185 can be applied and adhered to the abrasive disk engaging face 189 of the sanding pad 184 thereby fixing the two relative to one another. As a result, a rotation of the drive plate 128 will induce a rotation of the sanding pad 184, which will induce a rotation of the abrasive sanding disk 185.

Of course, the abrasive sanding disk 185 has an abrasive face 183 opposite the sanding pad engaging face 181. Of course, the abrasive face 183 could be formed in any one of a number of ways that would occur to one skilled in the art. For example, the abrasive face 183 could be formed by coating the substrate layer 177 with a layer of abrasive material, such as aluminum oxide or the like. The grit of the abrasive face 183 could be calibrated based on the surface to be sanded and the type of finish desired. Although 100 grit is most common, abrasive faces 183 with 120 grit, 150 grit, and 220 grit could be chosen for finer sanding operations while 80 grit could be employed to enable more aggressive sanding.

Under the structure of the preferred embodiment, use of the invention is quite simple and convenient. Assuming a drywall sander 100 with a sanding head 118 devoid of an abrasive sanding disk 185. A user would begin with an abrasive sanding disk 185 complete with a protective layer 179. The protective layer 179 could be stripped from the sanding pad engaging face 181 of adhesive thereby leaving it exposed. The sanding pad engaging face 181 could then be aligned with and applied to the abrasive disk engaging face 189 of the sanding pad 184. With this, the sanding pad 184 and the abrasive sanding disk 185 would be rotationally fixed relative to one another whereby a rotation of the sanding drive plate 128 will induce a rotation of the sanding pad 184 and the rotation of the sanding pad 184 will cause a rotation of the abrasive sanding disk 185 thereby allowing a sanding of a given surface by applying the abrasive face 183 thereto. The abrasive sanding disk 185 of course could then be employed for a given amount of time but ultimately would become worn and in need of removal and replacement. Removing the abrasive sanding disk 185 simply requires that it be peeled away from the sanding pad 184 thereby separating the abrasive disk engaging face 189 from the sanding pad engaging face 181. With this, the expended abrasive sanding disk 185 can be discarded, and a new abrasive sanding disk 185 can be installed in the same manner as its predecessor.

Figure 9:
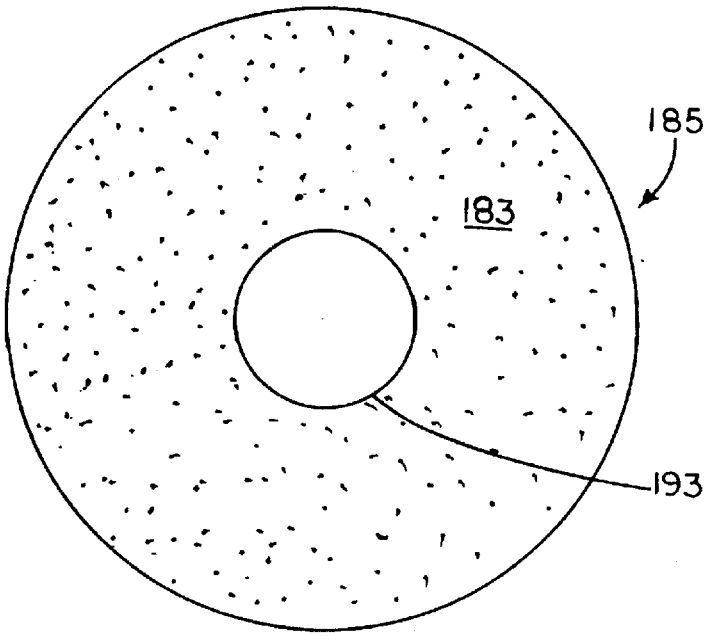
FIG. 9 is a bottom plan view of an alternative abrasive sanding disk.

Although it may reasonably be said in light of the discussion above to suffer from a number of drawbacks, yet another embodiment of the abrasive sanding disk 185 is depicted in FIG. 9 where the abrasive sanding disk 185 has a central aperture 193. There, the abrasive sanding disk 185 again has an abrasive face 183. Although not expressly shown in FIG. 9, the abrasive sanding disk 185 again has a sanding pad engaging face 181 comprising a layer of adhesive. Also, a protective layer 179 again can cover the sanding pad engaging face 181 and could be peeled therefrom prior to an engaging of the sanding pad engaging face 181 with a sanding pad 184. With the provision of the central aperture 187, the abrasive sanding disk 185 better accommodates drywall sanders 100 that have vacuum systems for drawing in particulate matter that has been sanded from a given surface.

Figure 10:
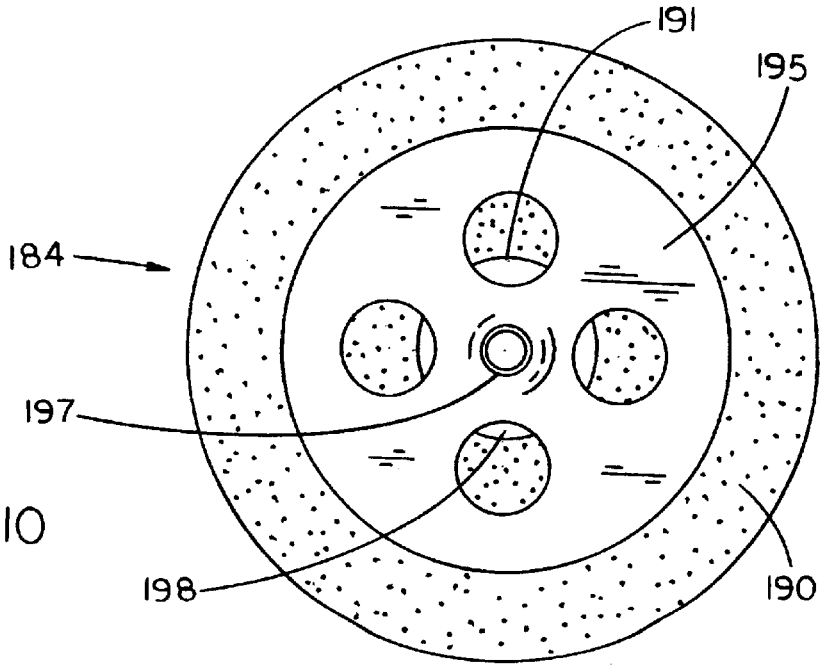
FIG. 10 is a top plan view of an alternative sanding pad according to the present invention.

FIG. 10 depicts yet another embodiment of the sanding pad 184. Here, the sanding pad 184 again has a central aperture 191, a sanding drive plate engaging face 190, and an abrasive disk engaging face 189 (not shown in this figure). Also, the sanding pad 184 is again constructed from a resiliently compressible material. In this embodiment, however, the sanding pad 184 eliminates all need for the retaining nut 194 and washer 192 combination for securing the sanding pad 184 to a retaining spindle 196 of a drywall sander 100. To do this, the sanding pad 194 has a rigid panel 195, which in this case is circular, fixed concentrically thereto. At the center of the rigid panel 195 is a threaded aperture 197 for threadedly engaging a retaining spindle 196 of a drywall sander 100. In this embodiment, the rigid panel 195 is formed from a plastic or the like while the threaded aperture 197 is formed by a metal insert in the rigid panel 195. The central portion of the rigid panel 195 is frustoconical to provide a thickened portion in the area of the threaded aperture 197 to enable additional threading and strength.

Advantageously, a plurality of apertures 198 are disposed in the rigid panel 195 in alignment with portions of the central aperture 191 in the sanding pad 194. With this, a vacuum system of a drywall sander 100 can readily draw air and debris from a given surface, through the central aperture 191 in the sanding pad 194, through the apertures 198 in the rigid panel 195, and into the vacuum system of the drywall sander 100. Although the apertures 198 in the rigid panel 195 certainly could pursue a variety of embodiment, in this case the apertures 198 comprise four circular cutouts evenly disposed around the rigid panel 195 with portions of the apertures 198 overlapping the central aperture 191 in the sanding pad 194 to create four through-holes through the sanding pad 184 and the rigid panel 195.

From the foregoing, one will appreciate that the present invention achieves a number of advantages over the prior art. Most generally, the invention provides an abrasive sanding disk 185 and sanding pad 184 that are particularly crafted for sanding drywall and that satisfy the deficiencies that had been left unmet by the prior art. More particularly, by providing an abrasive sanding disk 185 with a sanding pad engaging face 181 of adhesive in combination with a sanding pad 184 with a smooth abrasive disk engaging face 189, the invention provides an abrasive sanding disk 185 that can be readily removed and replaced relative to a sanding head 118 of a drywall sander 100. Furthermore, by eliminating the central aperture 193 included in prior art abrasive sanding disks 185, the present invention provides an abrasive sanding disk 185 that resists tearing and thereby demonstrates added durability over prior art abrasive sanding disks 185. By the same construction, the solid, non-apertured abrasive sanding disk 185 is capable of providing improved sanding results as compared to prior art sanding disks 185. Still further, the abrasive sanding disk 185 of the present invention resists causing damage to drywall surfaces that are to be sanded. Even further, by providing a sanding pad 184 with a smooth abrasive disk engaging face 189, the invention allows plural abrasive sanding disks 185 to be used before requiring replacement of the sanding pad 184. Naturally, one skilled in the art will be aware of still further advantages of the present invention.

It will be clear that the present invention has been shown and described with reference to certain preferred embodiments that merely exemplify the broader invention revealed herein. Certainly those skilled in the art can conceive of alternative embodiments. For instance, those with the major features of the invention in mind could craft embodiments that incorporate those major features while not incorporating all of the features included in the preferred embodiments.

With the foregoing in mind, the following claims are intended to define the scope of protection to be afforded the inventor. The claims shall be deemed to include equivalent constructions insofar as they do not depart from the spirit and scope of the invention. A plurality of the following claims express certain elements as means for performing a specific function, at times without the recital of structure or material. As the law demands, these claims shall be construed to cover not only the corresponding structure and material expressly described in the specification but also equivalents thereof.

I claim as deserving the protection of United States Letters Patent:

1. An abrasive sanding disk for use in sanding drywall surfaces with a motorized drywall sander with a sanding head, the abrasive sanding disk comprising a flat, circular substrate panel wherein the substrate panel is devoid of a central aperture, wherein the substrate panel has a first face comprising a sanding head engaging face for facing a sanding head of a drywall sander and a second face comprising an abrasive face for abrading a given surface, and further comprising a layer of adhesive disposed over substantially the entire sanding head engaging face of the substrate panel whereby the abrasive sanding disk can be affixed to a sanding head of a drywall sander by applying the sanding head engaging face of the substrate panel to the sanding head.

2. The abrasive sanding disk of claim 1 wherein the layer of adhesive comprises a layer of pressure sensitive adhesive.

3. The abrasive sanding disk of claim 2 further comprising a flexible protective film overlying the layer of pressure sensitive adhesive whereby the protective film covers and protects the layer of pressure sensitive adhesive when the protective film overlies the layer of pressure sensitive adhesive and whereby the layer of pressure sensitive adhesive can be exposed by a peeling of the protective film away from the layer of pressure sensitive adhesive.

4. The abrasive sanding disk of claim 3 wherein the abrasive sanding disk has a diameter of about nine inches.

5. The abrasive sanding disk of claim 3 further comprising a sanding pad for being interposed between the abrasive sanding disk and a sanding head of a drywall sander wherein the sanding pad comprises a round disk of resiliently compressible material with a concentric central aperture, an abrasive disk engaging face for engaging the abrasive sanding disk, and a sanding head engaging face for engaging a sanding head of a drywall sander.

6. The abrasive sanding disk of claim 5 wherein the abrasive disk engaging face of the sanding pad comprises a smooth surface whereby the layer of pressure sensitive adhesive of the sanding head engaging face of the abrasive sanding disk can be applied to the abrasive disk engaging face of the sanding pad and whereby the layer of pressure sensitive adhesive of the sanding head engaging face of the abrasive sanding disk can be peeled from the abrasive disk engaging face of the sanding pad without damage to the abrasive sanding disk or the sanding pad.

7. The abrasive sanding disk of claim 6 wherein the sanding head engaging face of the sanding pad is textured whereby frictional contact between the sanding head engaging face of the sanding pad and the sanding head is improved.

8. The abrasive sanding disk of claim 5 wherein the sanding pad comprises a round disk of white rubber.

9. The abrasive sanding disk of claim 5 wherein the sanding pad comprises a round disk of foam material and further comprising a panel of rubber affixed to the abrasive disk engaging face of the sanding pad for preventing a tearing of the sanding pad.

10. The abrasive sanding disk of claim 5 further comprising a rigid panel affixed to the sanding pad wherein the rigid panel has a concentric aperture therein.

11. The abrasive sanding disk of claim 10 further comprising at least one through-hole disposed through the sanding pad and the rigid panel for allowing air and debris to pass therethrough.

12. The abrasive sanding disk of claim 11 wherein the at least one through-hole is formed by at least one aperture in the rigid panel with a portion of the at least on aperture aligned with the central aperture in the sanding pad.

13. An abrasive sanding disk and sanding pad combination for use in sanding drywall surfaces with a motorized drywall sander with a sanding head, the abrasive sanding disk and sanding pad combination comprising:

an abrasive sanding disk comprising a flat, circular substrate panel wherein the substrate panel is devoid of a central aperture, wherein the substrate panel has a first face comprising a sanding head engaging face for facing a sanding head of a drywall sander and a second face comprising an abrasive face for abrading a given surface, and further comprising a layer of adhesive disposed over substantially the entire sanding head engaging face of the substrate panel whereby the abrasive sanding disk can be affixed to a sanding head of a drywall sander by applying the sanding head engaging face of the substrate panel to the sanding head; and a sanding pad for being interposed between the abrasive sanding disk and a sanding head of a drywall sander wherein the sanding pad comprises a round disk of resiliently compressible material with a concentric central aperture, an abrasive disk engaging face for engaging the abrasive sanding disk, and a sanding head engaging face for engaging a sanding head of a drywall sander.

14. The abrasive sanding disk and sanding pad combination of claim 13 wherein the layer of adhesive on the sanding head engaging face of the substrate panel comprises a layer of pressure sensitive adhesive and further comprising a flexible protective film overlying the layer of pressure sensitive adhesive on the sanding head engaging face whereby the protective film covers and protects the layer of pressure sensitive adhesive when the protective film overlies the layer of pressure sensitive adhesive and whereby the layer of pressure sensitive adhesive can be exposed by a peeling of the protective film away from the layer of pressure sensitive adhesive.

15. The abrasive sanding disk and sanding pad combination of claim 13 wherein the abrasive disk engaging face of the sanding pad comprises a smooth surface whereby the layer of pressure sensitive adhesive of the sanding head engaging face of the abrasive sanding disk can be applied to the abrasive disk engaging face of the sanding pad and whereby the layer of pressure sensitive adhesive of the sanding head engaging face of the abrasive sanding disk can be peeled from the abrasive disk engaging face of the sanding pad without damage to the abrasive sanding disk or the sanding pad.

16. The abrasive sanding disk and sanding pad combination of claim 13 wherein the sanding pad comprises a round disk of white rubber.

17. The abrasive sanding disk and sanding pad combination of claim 13 wherein the sanding pad comprises a round disk of foam material and further comprising a panel of rubber affixed to the abrasive disk engaging face of the sanding pad for preventing a tearing of the sanding pad.

18. The abrasive sanding disk and sanding pad combination of claim 13 further comprising a rigid panel affixed to the sanding pad wherein the rigid panel has a concentric aperture therein.

19. The abrasive sanding disk and sanding pad combination of claim 18 further comprising at least one through-hole disposed through the sanding pad and the rigid panel for allowing air and debris to pass therethrough.

20. The abrasive sanding disk and sanding pad combination of claim 19 wherein the at least one through-hole is formed by at least one aperture in the rigid panel with a portion of the at least on aperture aligned with the central aperture in the sanding pad.

* * * * *